US010102951B2

(12) United States Patent
Oda et al.

(10) Patent No.: US 10,102,951 B2
(45) Date of Patent: Oct. 16, 2018

(54) NON-ORIENTED ELECTRICAL STEEL SHEET HAVING EXCELLENT MAGNETIC PROPERTIES

(71) Applicant: JFE STEEL CORPORATION, Chiyoda-ku, Tokyo (JP)

(72) Inventors: Yoshihiko Oda, Tokyo (JP); Hiroaki Toda, Tokyo (JP); Shinji Koseki, Tokyo (JP); Tatsuhiko Hiratani, Tokyo (JP); Tadashi Nakanishi, Tokyo (JP); Tomoyuki Okubo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 400 days.

(21) Appl. No.: 14/774,258

(22) PCT Filed: Mar. 11, 2014

(86) PCT No.: PCT/JP2014/056267
§ 371 (c)(1),
(2) Date: Sep. 10, 2015

(87) PCT Pub. No.: WO2014/142100
PCT Pub. Date: Sep. 18, 2014

(65) Prior Publication Data

US 2016/0042850 A1 Feb. 11, 2016

(30) Foreign Application Priority Data

Mar. 13, 2013 (JP) ..... 2013-049757
Dec. 20, 2013 (JP) ..... 2013-264050

(51) Int. Cl.

| | |
|---|---|
| ***H01F 1/147*** | (2006.01) |
| ***C22C 38/00*** | (2006.01) |
| ***C22C 38/06*** | (2006.01) |
| ***C22C 38/60*** | (2006.01) |
| ***H01F 1/16*** | (2006.01) |
| ***C22C 38/02*** | (2006.01) |
| ***C22C 38/04*** | (2006.01) |
| *C21D 8/12* | (2006.01) |

(52) U.S. Cl.
CPC ..... *H01F 1/14775* (2013.01); *C22C 38/00* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/16* (2013.01); *C21D 8/12* (2013.01)

(58) Field of Classification Search
CPC ..... H01F 1/14775
See application file for complete search history.

(56) References Cited

U.S. PATENT DOCUMENTS

| | | | |
|---|---|---|---|
| 5,637,157 | A | 6/1997 | Takashima et al. |
| 5,803,988 | A | 9/1998 | Bae et al. |
| 7,922,834 | B2 | 4/2011 | Tanaka et al. |
| 8,157,928 | B2 | 4/2012 | Tanaka et al. |
| 9,085,817 | B2 | 7/2015 | Miyazaki et al. |
| 2004/0149355 | A1 | 8/2004 | Kohno et al. |
| 2007/0062611 | A1 | 3/2007 | Murakami |
| 2008/0121314 | A1 | 5/2008 | Choi et al. |
| 2009/0202383 | A1 | 8/2009 | Tanaka et al. |
| 2010/0158744 | A1 | 6/2010 | Murakami |
| 2012/0014828 | A1 | 1/2012 | Miyazaki et al. |
| 2014/0345751 | A1 | 11/2014 | Oda et al. |
| 2015/0059929 | A1 | 3/2015 | Zaizen et al. |
| 2015/0136278 | A1 | 5/2015 | Nakanishi et al. |

FOREIGN PATENT DOCUMENTS

| | | | |
|---|---|---|---|
| CN | 1133891 | A | 10/1996 |
| CN | 101218362 | A | 7/2008 |
| CN | 102634742 | | 8/2012 |
| EP | 1411138 | | 4/2004 |
| EP | 1501951 | | 2/2005 |
| EP | 1679386 | | 7/2006 |
| EP | 2657355 | A1 | 10/2013 |
| JP | 03219020 | A | 9/1991 |
| JP | H03229820 | A | 10/1991 |
| JP | 0673511 | A | 3/1994 |
| JP | 06108149 | | 4/1994 |
| JP | 06330260 | | 11/1994 |
| JP | 0860311 | | 3/1996 |
| JP | 0860311 | A | 3/1996 |
| JP | 2500033 | B2 | 5/1996 |
| JP | 08157966 | A | 6/1996 |

(Continued)

OTHER PUBLICATIONS

Korean Office Action for Application No. 2015-7024974, dated Sep. 9, 2016, with a Concise Statement of Relevance of Office Action, 6 pages.
Japanese Office Action dated Nov. 17, 2015 for Japanese Application No. JP2013-264050.
Taiwanese Office Action dated Sep. 10, 2015 for Taiwanese Application No. 103109021.
Chinese Office Action for Application No. 201480014256.6, dated Jun. 29 2016, with a partial English language Search Report, 8 pages.
Japanese Office Action for Application No. JP 2013-264050 dated Jun. 8, 2016, with an English language Concise Statement of Relevance of Office Action.

(Continued)

*Primary Examiner* — Jessee R Roe
*Assistant Examiner* — Jophy S. Koshy
(74) *Attorney, Agent, or Firm* — RatnerPrestia

(57) ABSTRACT

A non-oriented electrical steel sheet having a high magnetic flux density and a low anisotropy contains C: not more than 0.01 mass %, Si: 1-4 mass %, Mn: 0.05-3 mass %, P: 0.03-0.2 mass %, S: not more than 0.01 mass %, Al: not more than 0.004 mass %, N: not more than 0.005 mass %, As: not more than 0.003 mass %, and preferably further contains one or two of Sb: 0.001-0.1 mass % and Sn: 0.001-0.1 mass % or further contains one or two of Ca: 0.001-0.005 mass % and Mg: 0.001-0.005 mass %.

8 Claims, 2 Drawing Sheets

(56) References Cited

FOREIGN PATENT DOCUMENTS

| | | | |
|---|---|---|---|
| JP | 09125145 | | 5/1997 |
| JP | 09137261 | | 5/1997 |
| JP | 09263908 | | 10/1997 |
| JP | 1060532 | | 3/1998 |
| JP | 10237606 | | 9/1998 |
| JP | 2970436 | B2 | 11/1999 |
| JP | 11310857 | | 11/1999 |
| JP | 2000096196 | | 4/2000 |
| JP | 2000129410 | | 5/2000 |
| JP | 2000129410 | A | 5/2000 |
| JP | 2000219916 | | 8/2000 |
| JP | 2000219917 | | 8/2000 |
| JP | 2000273549 | A | 10/2000 |
| JP | 2000328207 | A | 11/2000 |
| JP | 2001011588 | A | 1/2001 |
| JP | 2001131717 | A | 5/2001 |
| JP | 2001158949 | A | 6/2001 |
| JP | 2001192788 | | 7/2001 |
| JP | 2001192788 | A | 7/2001 |
| JP | 2001323344 | A | 11/2001 |
| JP | 2001323345 | A | 11/2001 |
| JP | 2001335897 | | 12/2001 |
| JP | 2002030397 | | 1/2002 |
| JP | 200247542 | A | 2/2002 |
| JP | 2003055746 | | 2/2003 |
| JP | 2004292829 | | 10/2004 |
| JP | 2005200756 | A | 7/2005 |
| JP | 2005264315 | A | 9/2005 |
| JP | 2006104530 | A | 4/2006 |
| JP | 3870893 | B2 | 1/2007 |
| JP | 2007016278 | A | 1/2007 |
| JP | 2007031793 | A | 2/2007 |
| JP | 2007046104 | | 2/2007 |
| JP | 2007247047 | A | 9/2007 |
| JP | 4126479 | B2 | 7/2008 |
| JP | 2008156737 | | 7/2008 |
| JP | 2008524449 | A | 7/2008 |
| JP | 2008231504 | A | 10/2008 |
| JP | 2010248559 | A | 11/2010 |
| JP | 2012001772 | A | 1/2012 |
| JP | 2012036454 | A | 2/2012 |
| JP | 2012140676 | A | 7/2012 |
| JP | 2013189693 | A | 9/2013 |
| JP | 2014040622 | | 3/2014 |
| RU | 2134727 | C1 | 8/1999 |
| RU | 2398894 | C1 | 6/2006 |
| TW | 201207121 | A | 2/2012 |
| TW | 201319273 | A | 5/2013 |
| TW | 201402834 | A | 1/2014 |
| WO | 2004013365 | | 2/2004 |
| WO | 2005033349 | | 4/2005 |
| WO | 2006033286 | A1 | 3/2006 |
| WO | 2010140509 | A1 | 12/2010 |
| WO | 2011155183 | A1 | 12/2011 |
| WO | 2013137092 | A1 | 9/2013 |
| WO | 2014027452 | A1 | 2/2014 |

OTHER PUBLICATIONS

Korean Office Action with partial English language translation for Application No. 10-2015-7024974, dated Mar. 13, 2017, 6 pages.

Chinese Office Action and Search Report with partial English language translation, dated Jan. 16, 2017, 8 pages.

Non Final Office Action for U.S. Appl. No. 14/767,735, dated Jun. 26, 2017, 14 pages.

International Search Report for International Application No. PCT/JP2014/056267 dated May 27, 2014.

Non Final Office Action for U.S. Appl. No. 15/111,310, dated Apr. 4, 2017, 9 pages.

Final Office Action for U.S. Appl. No. 14/767,735, dated Dec. 6, 2017, 9 pages.

Extended European Search Report dated Mar. 4, 2016 in European Application No. 14765508.8-1373.

Final Office Action for U.S. Appl. No. 15/111,310, dated Oct. 27, 2017, 10 pages.

Non Final Office Action for U.S. Appl. No. 14/775,925, dated Feb. 28, 2017, 10 pages.

Non Final Office Action for U.S. Appl. No. 14/909,978, dated Apr. 4, 2017, 12 pages.

Russian Office Action with English language translation for Application No. 2015143615, dated Dec. 2, 2016, 9 pages.

Special Steels, Manual for High Schools, M. I. Goldshtein et al., p. 408, Moscow, Metallurgiya, 1985, 3 pages.

Non Final Office Action for U.S. Appl. No. 14/418,351, dated Mar. 10, 2017, 8 pages.

Chinese Office Action for Chinese Application No. 201580041991.0 dated Oct. 17, 2017, including English translation, 8 pages.

Non Final Office Action for U.S. Appl. No. 15/503,508, dated Mar. 9, 2018, 16 pages.

Extended European Search Report for European Application No. 15 833 925.9, dated Nov. 17, 2017, 11 pages.

Non Final Office Action for U.S. Appl. No. 15/111,310, dated Mar. 8, 2018, 14 pages.

Final Office Action for U.S. Appl. No. 14/775,925, dated Aug. 10, 2018, 9 pages.

Final Office Action for U.S. Appl. No. 15/503,508, dated Aug. 15, 2018, 10 pages.

NON-ORIENTED ELECTRICAL STEEL SHEET HAVING EXCELLENT MAGNETIC PROPERTIES

CROSS REFERENCE TO RELATED APPLICATIONS

This is the U.S. National Phase application of PCT International Application No. PCT/JP2014/056267, filed Mar. 11, 2014, and claims priority to Japanese Patent Application No. 2013-049757, filed Mar. 13, 2013, and Japanese Patent Application No. 2013-264050, filed Dec. 20, 2013, the disclosures of each of these applications being incorporated herein by reference in their entireties for all purposes.

FIELD OF THE INVENTION

This invention relates to a non-oriented electrical steel sheet having excellent magnetic properties, and more particularly to a non-oriented electrical steel sheet having a high magnetic flux density.

BACKGROUND OF THE INVENTION

Recently, high-efficiency induction motors are used in view of the increasing demand for energy-saving. In order to improve the efficiency of this motor, a laminate thickness of a core is increased or a filling rate of winding wires is improved. In addition, as a material for the electrical steel sheet used in the core is promoted an exchange from the conventional low-grade material to a high-grade material having a lower iron loss.

A steel sheet used as a core material of the induction motor is required to be not only low in the iron loss but also low in the effective excitation current at a predetermined magnetic flux density from a viewpoint of reducing the copper loss. In order to reduce the excitation current, it is effective to increase a magnetic flux density of the core material.

Further, in a driving motor used in hybrid cars and electric cars which become popular rapidly, it is necessary to have a high torque at startup or accelerated period, so that it is desired to further improve a magnetic flux density.

As an electrical steel sheet having a high magnetic flux density, for example, Patent Document 1 discloses a non-oriented electrical steel sheet in which 0.1-5 mass % of Co is added to a steel having Si≤4 mass %.

PATENT DOCUMENT

Patent Document 1: JP-A-2000-129410

SUMMARY OF THE INVENTION

However, since Co is very expensive, if the material disclosed in Patent Document 1 is applied to a core material of the motor, there is a problem that the production cost is extraordinarily increased. Therefore, it is desired to develop a non-oriented electrical steel sheet having an improved magnetic flux density without increasing the production cost.

In the non-oriented electrical steel sheet used in the motor, since an excitation direction is rotated in a sheet plane during the rotation of the motor, magnetic properties in not only a rolling direction (L-direction) but also a direction perpendicular to the rolling direction (C-direction) affect the motor properties. Therefore, the non-oriented electrical steel sheet is strongly desired to be excellent in the magnetic properties in L-direction and C-direction and small in the difference of magnetic properties between L-direction and C-direction or the anisotropy.

The invention is made in view of the above problems of the conventional art, and an object thereof is to provide a non-oriented electrical steel sheet having a high magnetic flux density without causing the increase of the production cost.

The inventors have made various studies for solving the above task. As a result, it has been found that a high magnetic flux density can be attained without requiring specific additive elements by adding P to a steel having a reduced Al content and decreasing As therefrom, and the invention has been accomplished.

That is, the invention includes providing a non-oriented electrical steel sheet having a chemical composition comprising C: not more than 0.01 mass %, Si: 1-4 mass %, Mn: 0.05-3 mass %, P: 0.03-0.2 mass %, S: not more than 0.01 mass %, Al: not more than 0.004 mass %, N: not more than 0.005 mass %, As: not more than 0.003 mass % and the remainder being Fe and inevitable impurities.

The non-oriented electrical steel sheet of an embodiment of the invention is characterized by further containing one or two of Sb: 0.001-0.1 mass % and Sn: 0.001-0.1 mass % in addition to the above chemical composition.

Also, the non-oriented electrical steel sheet of an embodiment of the invention is characterized by further containing one or two of Ca: 0.001-0.005 mass % and Mg: 0.001-0.005 mass % in addition to the above chemical composition.

Further, the non-oriented electrical steel sheet of an embodiment of the invention is characterized in that a ratio ($B_{50L}/B_{50C}$) of magnetic flux density $B_{50L}$, in a rolling direction (L-direction) to magnetic flux density $B_{50C}$ in a direction perpendicular to the rolling direction (C-direction) is not more than 1.05.

Moreover, the non-oriented electrical steel sheet of an embodiment of the invention is characterized in that a sheet thickness is 0.05-0.30 mm.

According to the invention, it is possible to cheaply provide a non-oriented electrical steel sheet having a high magnetic flux density, so that it can be preferably used as a core material for a high-efficiency induction motor, a driving motor of a hybrid car and an electric car requiring a high torque, a high-efficiency electric generator requiring a high generation efficiency and so on.

DETAILED DESCRIPTION OF EMBODIMENTS OF THE INVENTION

Hereinafter, experiments building a momentum on the development of the invention will be described.

At first, in order to investigate an influence of P upon iron loss, steels prepared by adding P changed within a range of trace amount (hereafter "tr.") –0.15 mass % to two kinds of a steel (Al-added steel) containing C: 0.0025 mass %, Si: 3.05 mass %, Mn: 0.25 mass%, S: 0.0021 mass %, Al: 0.30mass % and N: 0.0021 mass % and a steel (Al-less steel) containing C: 0.0022 mass %, Si: 3.00 mass %, Mn: 0.24mass %, S: 0.0018 mass %, Al: 0.002 mass % and N: 0.0020mass % are melted in a laboratory to form steel ingots, which are hot rolled to form hot rolled sheets of 1.6 mm in thickness. Thereafter, the hot rolled sheets are subjected to a hot band annealing at 1000° C. for 30seconds, pickled and cold rolled to form cold rolled sheets having a thickness of 0.20 mm, which are further subjected to a final annealing at 1000° C. in an atmosphere of 20 vol % $H_2$- 80 vol % $N_2$for 10 seconds.

Figure 1:
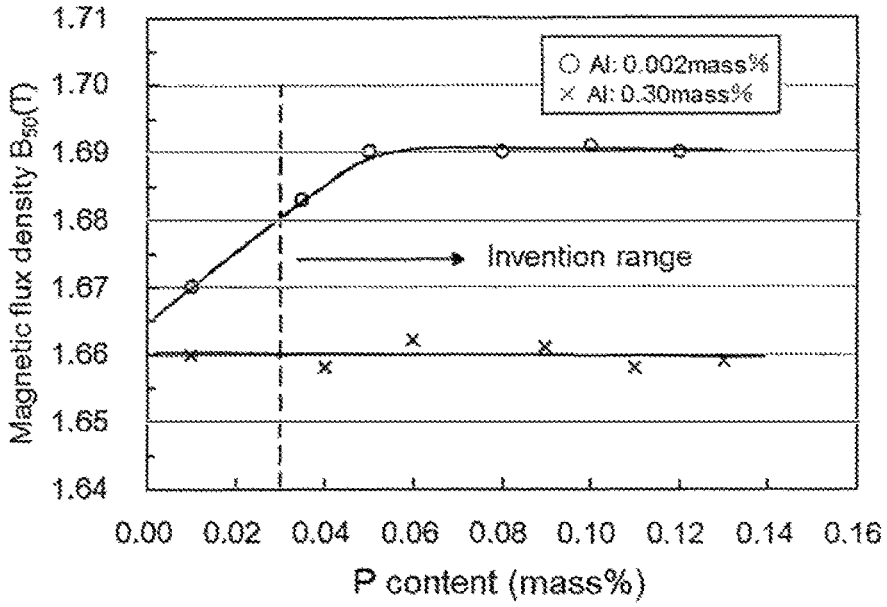
FIG. 1 is a graph showing an influence of Al and P contents upon a magnetic flux density $B_{50}$.

From the cold rolled and annealed sheets thus obtained are cut out test specimens with width: 30 mm×length: 280 mm to measure a magnetic flux density $B_{50}$ by Epstein method. The results are shown in FIG. 1 as a relation between P content and magnetic flux density $B_{50}$. Here, the magnetic flux density $B_{50}$ means a magnetic flux density measured at a magnetization force of 5000 A/m on half quantities of the test specimen with a rolling direction along a longitudinal direction and the test specimen with a rolling direction perpendicular to the longitudinal direction. As seen from this figure, it is understood that an improvement of magnetic flux density is not admitted even by the addition of P in the Al-added steel, while the magnetic flux density is improved by adding not less than 0.03 mass % of P in the Al-less steel.

The reason why the effect of improving the magnetic flux density by the addition of P is obtained only in the Al-less steel as described above is not sufficiently clear, but it is thought that P has an effect of improving the magnetic flux density by segregating into grain boundaries. On the contrary, it is thought in the Al-added steel that the addition of Al somewhat affects the segregation behavior of P before the cold rolling to suppress the segregation of P into grain boundaries.

Then, with respect to the two cold rolled and annealed sheets of the Al-added steel and the Al-less steel obtained by the above experiment are measured a magnetic flux density $B_{50L}$ in the rolling direction (L-direction) and a magnetic flux density $B_{50C}$ in the direction perpendicular to the rolling direction (C-direction) to investigate the influence of P content upon an anisotropy of magnetic flux density. In the invention, a ratio ($B_{50L}/B_{50C}$) between the magnetic flux density $B_{50L}$ in the rolling direction (L-direction) and the magnetic flux density $B_{50C}$ in the direction perpendicular to the rolling direction (C-direction) is used as an indicator representing the anisotropy. As the value of this ratio becomes closer to 1, the anisotropy becomes smaller. Therefore, the invention has a development goal that the ratio ($B_{50L}/B_{50C}$) is made to not more than 1.05. Hereinafter, the ratio ($B_{50L}/B_{50C}$) between the magnetic flux density $B_{50L}$ in the rolling direction (L-direction) and the magnetic flux density $B_{50C}$ in the direction perpendicular to the rolling direction (C-direction) is referred to as "anisotropy ($B_{50L}/B_{50C}$)" simply.

Figure 2:
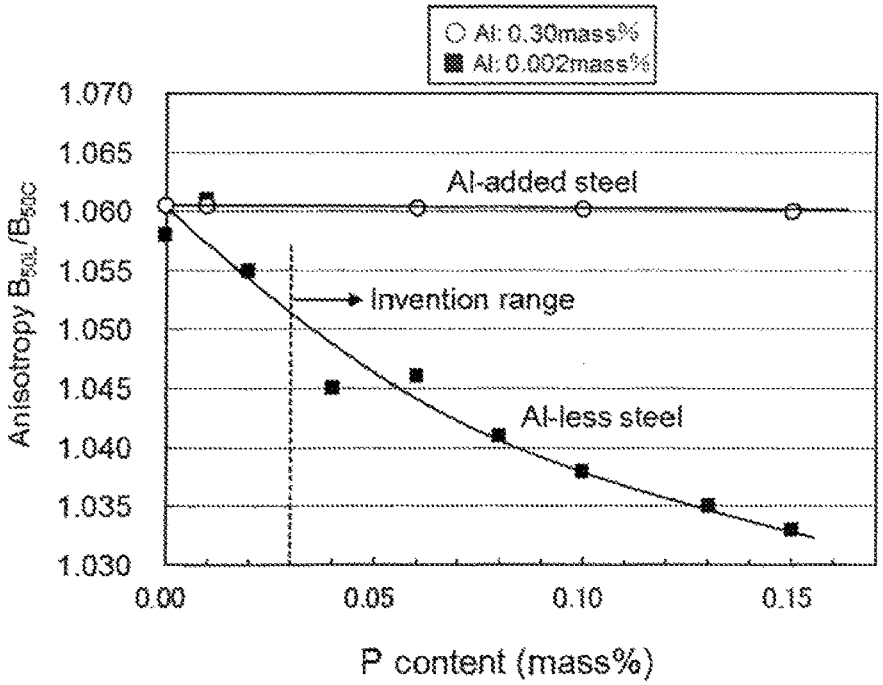
FIG. 2 is a graph showing an influence of Al and P contents upon an anisotropy ($B_{50L}/B_{50C}$) of a magnetic flux density.

In FIG. 2 is shown a relation between P content and anisotropy ($B_{50L}/B_{50C}$). As seen from this figure, the anisotropy is reduced by adding P in the Al-less steel, and when the addition amount of P is not less than 0.03 mass %, the ratio ($B_{50L}/B_{50C}$) as an indicator of anisotropy can be decreased to not more than 1.05 which is the development goal.

The reason why the anisotropy is improved by adding P in the Al-less steel is not yet clear at the present time, but it is predicted that some change in the texture is caused due to the segregation of P into the grain boundary to reduce the anisotropy of the magnetic flux density.

Then, in order to investigate the production stability of steel added with P, a steel containing C: 0.0020 mass %, Si: 3.00 mass %, Mn: 0.20 mass %, P: 0.06 mass %, S: 0.0012 mass %, Al: 0.002 mass % and N: 0.0018 mass % is tapped at 10 charges and hot rolled to form a hot rolled sheet of 1.6 mm in thickness. The hot rolled sheet is subjected to a hot band annealing at 1000° C. for 30 seconds, pickled and cold rolled to obtain a cold rolled sheet of 0.35 mm in thickness, which is subjected to a final annealing at 1000° C. in an atmosphere of 20 vol % $H_2$ -80 vol % $N_2$ for 10 seconds.

When the magnetic flux density $B_{50}$ is investigated on the cold rolled and annealed sheet thus obtained, the measured results of $B_{50}$ are largely deviated. As a composition analysis is performed in the materials having a low magnetic flux density, As is included in an amount of 0.0020-0.0035 mass %. Therefore, it is thought that As is segregated into the grain boundary to suppress the segregation of P into the grain boundary and hence the magnetic flux density is decreased.

In general, As is an impurity incorporated from a scrap. Recently, since not only the amount incorporated but also the deviation become gradually large with the increase of the use rate of the scrap, it is thought that the above results are obtained.

Then, in order to investigate an influence of As upon the magnetic flux density, steels prepared by adding As changed within a range of tr.–0.008 mass % to two kinds of a steel (Al-added steel) containing C: 0.0015 mass %, Si: 3.10 mass %, Mn: 0.15 mass %, P: 0.05 mass %, S: 0.0009 mass %, Al: 0.30 mass % and N: 0.0018 mass % and a steel (Al-less steel) containing C: 0.0016 mass %, Si: 3.00 mass %, Mn: 0.15 mass %, P: 0.05 mass %, S: 0.0009 mass %, Al: 0.002 mass % and N: 0.0020 mass % are melted in a laboratory to form steel ingots, which are hot rolled to form hot rolled sheets each having a thickness of 1.6 mm. Thereafter, the hot rolled sheets are subjected to a hot band annealing at 1000° C. for 30 seconds, pickled and cold rolled to obtain cold rolled sheets each having a thickness of 0.35 mm, which are subjected to a final annealing at 1000° C. in an atmosphere of 20 vol % $H_2$-80 vol % $N_2$ for 10 seconds.

Figure 3:
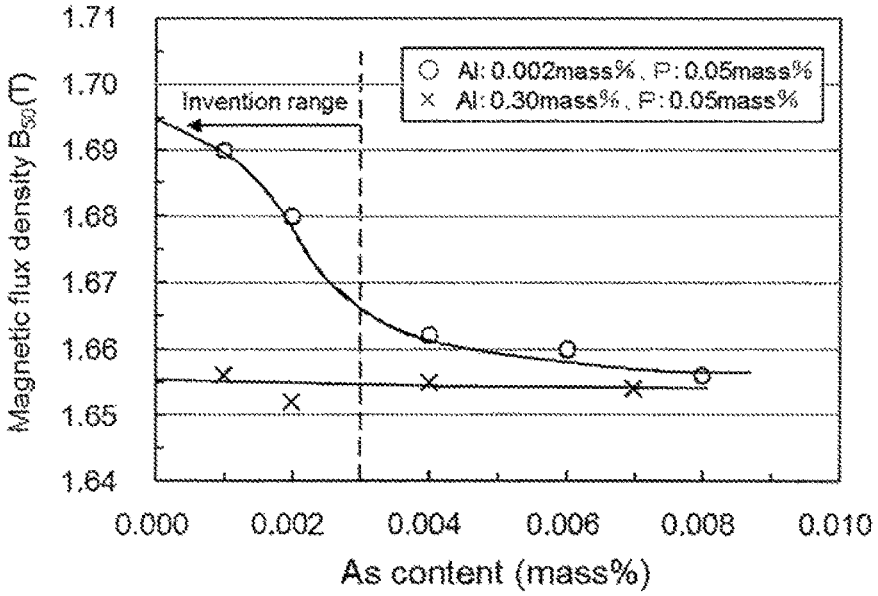
FIG. 3 is a graph showing an influence of As content upon a magnetic flux density $B_{50}$.

From the cold rolled and annealed sheets thus obtained are cut out test specimens with width: 30 mm×length: 280 mm to measure a magnetic flux density $B_{50}$ by Epstein method. The results are shown in FIG. 3 as a relation between As content and magnetic flux density $B_{50}$. As seen from this figure, the magnetic flux density is decreased when As content exceeds 0.003 mass %.

Figure 4:
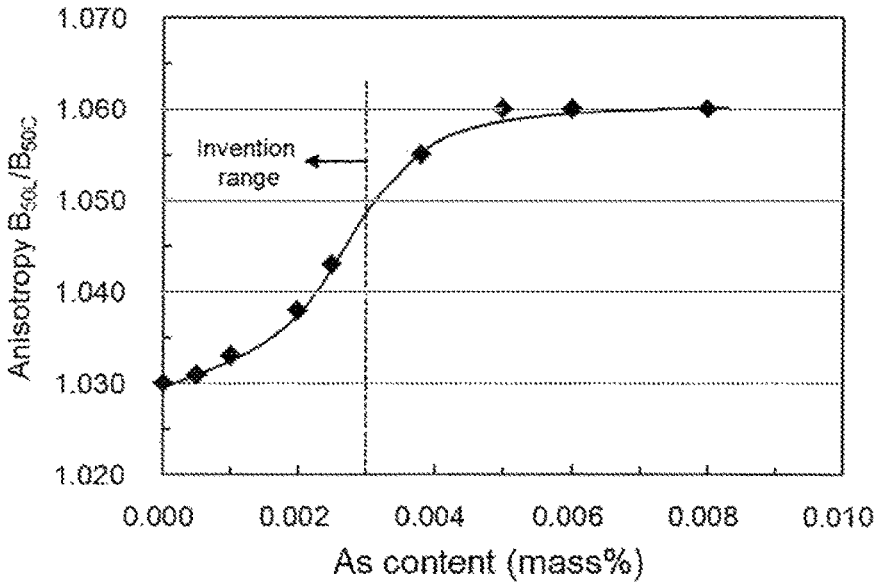
FIG. 4 is a graph showing an influence of As content upon an anisotropy ($B_{50L}/B_{50C}$) of a magnetic flux density.

Then, $B_{50L}$ and $B_{50C}$ are measured by using the test specimens obtained by the above experiment, and shown in FIG. 4 as a relation between As content and ($B_{50L}/B_{50C}$). As seen from this figure, when the As content is not more than 0.003 mass %, the anisotropy of magnetic flux density becomes small, and the ratio ($B_{50L}/B_{50C}$) as an indicator of anisotropy can be made to a target value of not more than 1.05. This reason is thought due to the fact that when As content is decreased, the amount of As segregated into the grain boundary becomes small, and the segregation of P, which is the same segregation element, into the grain boundary is promoted to improve the texture, and hence the effect of decreasing the anisotropy by the addition of P as clear from FIG. 2 is further advantaged.

The invention is developed based on the above new knowledge.

The chemical composition in the non-oriented electrical steel sheet according to embodiments of the invention will be described below.

C: Not More than 0.01 mass %

When C is contained in a product sheet at an amount exceeding 0.01 mass %, magnetic aging is caused, so that an upper limit is 0.01 mass %. Preferably, the content is not more than 0.005 mass %.

Si: 1-4 mass %

Si is an element effective for increasing a specific resistance of steel and reducing an iron loss, and is added in an amount of not less than 1 mass% in an embodiment of the invention. On the other hand, when it is added in an amount exceeding 4 mass %, an excitation effective current is extraordinarily increased. In the invention, therefore, Si is in a range of 1-4 mass %. Preferably, a lower limit of Si is 2.0 mass % and an upper limit thereof is 3.5mass %.

Mn: 0.05-3mass %

Mn is necessary to be added in an amount of not less than 0.05 mass % for preventing a hot-shortness during the hot rolling. When it exceeds 3 mass %, a saturation magnetic flux density is lowered to decrease the magnetic flux density. Therefore, Mn is in a range of 0.05-3 mass %. Preferably, a lower limit of Mn is 0.05 mass % and an upper limit thereof is 2.0 mass %.

P: 0.03-0.2 mass %

P is one of important elements in the invention, and has an effect of increasing the magnetic flux density by adding in an amount of not less than 0.03 mass % to a steel containing Al decreased to not more than 0.004 mass % as seen from FIG. 1. However, when it is added in an amount exceeding 0.2 mass %, the steel is hardened and becomes difficult to perform the cold rolling, so that an upper limit is set to 0.2 mass %. Preferably, a lower limit of P is 0.05 mass % and an upper limit thereof is 0.10 mass %.

S: not more than 0.01 mass %

S is a harmful element forming a sulfide such as MnS or the like to inhibit grain growth and increase iron loss, so that an upper limit is set to 0.01 mass %. Moreover, since S is also an element of grain boundary segregation type, as S content becomes large, the grain boundary segregation of P tends to be suppressed, so that it is preferably not more than 0.0009 mass % from a viewpoint of promoting the grain boundary segregation of P.

Al: not more than 0.004 mass %

Al is one of important elements in the invention. When it is added in an amount exceeding 0.004mass %, the effect of improving the magnetic flux density by the addition of P as mentioned above cannot be obtained, so that an upper limit is set to 0.004 mass %. Preferably, it is not more than 0.002 mass %.

N: not more than 0.005 mass %

N is a harmful element forming a nitride to inhibit grain growth and increase iron loss, so that an upper limit is set to 0.005 mass %. Preferably, it is not more than 0.003 mass %.

As: not more than 0.003 mass %

As is one of important elements in the invention, but is a harmful element segregating into the grain boundary to suppress the grain boundary segregation of P and decrease the magnetic flux density in a low-Al, P-added steel as previously mentioned. In the invention, therefore, As content is limited to not more than 0.003 mass %. Preferably, it is not more than 0.002 mass %, more preferably not more than 0.001 mass %.

The non-oriented electrical steel sheet according to the invention may contain one or two of Sb and Sn in the following range in addition to the above ingredients.

Sb: 0.001-0.1 mass %, Sn: 0.001-0.1 mass %

Sb is a grain boundary segregation element and has an effect for improving the magnetic flux density, and can be added in a range of 0.001-0.1 mass % since an influence on P segregation is little.

On the other hand, Sn is a grain boundary segregation element and is little in the influence on P segregation and has an effect of accelerating a formation of deformable band inside grains to improve the magnetic flux density, and can be added in a range of 0.001-0.1 mass %. More preferably, a lower limit of Sb and Sn is 0.005 mass % and an upper limit thereof is 0.05 mass %.

The non-oriented electrical steel sheet according to the invention may contain one or two of Ca and Mg in the following range in addition to the above ingredients.

Ca: 0.001-0.005 mass %, Mg: 0.001-0.005 mass %

Ca and Mg have an effect of coarsening a sulfide to promote grain growth and reduce an iron loss, and can be added in a range of 0.001-0.005 mass %, respectively. More preferably, a lower limit of Ca and Mg is 0.0015 mass % and an upper limit thereof is 0.003 mass %.

Moreover, the remainder other than the above ingredients in the non-oriented electrical steel sheet according to an embodiment of the invention is Fe and inevitable impurities. However, the other elements may not be refused as long as they are included within a range damaging no function effect of the invention.

Next, the production method of the non-oriented electrical steel sheet according to embodiments of the invention will be described below.

In the method for producing the non-oriented electrical steel sheet according to the invention, conditions are not particularly limited except that steel ingredients, especially Al, P and As are necessary to be controlled to the above-mentioned ranges, so that the production may be performed under the same conditions as in the normal non-oriented electrical steel sheet. For example, the steel sheet can be produced by a method wherein a steel having a chemical composition adapted to the invention is melted, for example, in a converter, a degassing device or the like and shaped into a raw steel material (slab) by a continuous casting method or an ingot making-blooming method, which is hot rolled, subjected to a hot band annealing as required and further to a single cold rolling or two or more cold rollings including an intermediate annealing therebetween to a predetermined sheet thickness and subsequently to a final annealing.

EXAMPLES

A steel having a chemical composition shown in Table 1 is melted in a converter, degassed by blowing and continuously cast into a slab, which is reheated at 1140° C. for 1 hour, hot rolled at a final rolling temperature of 800° C. and wound into a coil at a temperature of 610° C. to obtain a hot rolled sheet of 1.6 mm in thickness. Thereafter, the hot rolled sheet is subjected to a hot band annealing at 1000° C. in an atmosphere of 100 vol % $N_2$ for 30 seconds and cold rolled to obtain a cold rolled sheet having a sheet thickness of 0.25 mm, which is subjected to a final annealing under the conditions shown in Table 1 in an atmosphere of 20 vol % $H_2$-80 vol % $N_2$ to form a cold rolled and annealed sheet.

From the cold rolled and annealed sheet thus obtained, Epstein samples with a width: 30 mm×a length: 280 mm are cut out in the rolling direction (L-direction) and in a direction perpendicular to the rolling direction (C-direction) to measure an iron loss $W_{10/400}$, a magnetic flux density $B_{50}$ and an anisotropy ($B_{50L}/B_{50C}$) according to JIS C2550, respectively. These results are also shown in Table 1.

TABLE 1

| No. | Chemical composition (mass %) | | | | | | | | | | | |
|---|---|---|---|---|---|---|---|---|---|---|---|---|
| | C | Si | Mn | P | S | Al | N | As | Sb | Sn | Ca | Mg |
| 1 | 0.0020 | 3.00 | 0.21 | 0.011 | 0.0009 | 0.0010 | 0.0020 | tr. | tr. | 0.0010 | tr. | tr. |
| 2 | 0.0018 | 3.04 | 0.20 | 0.035 | 0.0009 | 0.0010 | 0.0020 | tr. | tr. | 0.0010 | tr. | tr. |
| 3 | 0.0015 | 3.02 | 0.18 | 0.050 | 0.0009 | 0.0010 | 0.0012 | tr. | tr. | 0.0010 | tr. | tr. |
| 4 | 0.0016 | 3.05 | 0.25 | 0.050 | 0.0015 | 0.0010 | 0.0016 | tr. | tr. | 0.0010 | tr. | tr. |
| 5 | 0.0016 | 3.05 | 0.25 | 0.050 | 0.0015 | 0.0020 | 0.0016 | tr. | tr. | 0.0010 | tr. | tr. |
| 6 | 0.0019 | 3.00 | 0.22 | 0.100 | 0.0009 | 0.0010 | 0.0019 | tr. | tr. | 0.0010 | tr. | tr. |
| 7 | 0.0018 | 2.80 | 0.19 | 0.050 | 0.0009 | 0.0050 | 0.0014 | tr. | tr. | 0.0010 | tr. | tr. |
| 8 | 0.0012 | 2.80 | 0.15 | 0.050 | 0.0009 | 0.3000 | 0.0012 | tr. | tr. | 0.0010 | tr. | tr. |
| 9 | 0.0013 | 3.00 | 0.14 | 0.050 | 0.0009 | 0.0010 | 0.0018 | 0.0010 | tr. | 0.0010 | tr. | tr. |
| 10 | 0.0018 | 3.00 | 0.21 | 0.050 | 0.0009 | 0.0010 | 0.0018 | 0.0022 | tr. | 0.0010 | tr. | tr. |
| 11 | 0.0020 | 3.00 | 0.21 | 0.050 | 0.0009 | 0.0010 | 0.0020 | 0.0042 | tr. | 0.0010 | tr. | tr. |
| 12 | 0.0023 | 2.80 | 0.21 | 0.050 | 0.0009 | 0.3000 | 0.0023 | 0.0031 | tr. | 0.0010 | tr. | tr. |
| 13 | 0.0012 | 3.04 | 0.21 | 0.050 | 0.0009 | 0.0010 | 0.0012 | tr. | 0.0020 | 0.0010 | tr. | tr. |
| 14 | 0.0017 | 3.10 | 0.20 | 0.050 | 0.0009 | 0.0010 | 0.0025 | tr. | 0.0300 | 0.0010 | tr. | tr. |
| 15 | 0.0012 | 3.12 | 0.23 | 0.050 | 0.0009 | 0.0010 | 0.0012 | tr. | tr. | 0.0025 | tr. | tr. |
| 16 | 0.0013 | 3.06 | 0.22 | 0.050 | 0.0009 | 0.0010 | 0.0020 | tr. | tr. | 0.0100 | tr. | tr. |
| 17 | 0.0018 | 3.09 | 0.21 | 0.050 | 0.0009 | 0.0010 | 0.0011 | tr. | tr. | 0.0500 | tr. | tr. |
| 18 | 0.0020 | 2.99 | 0.21 | 0.050 | 0.0025 | 0.0010 | 0.0019 | tr. | tr. | tr. | tr. | tr. |
| 19 | 0.0020 | 3.00 | 0.20 | 0.050 | 0.0025 | 0.0010 | 0.0018 | tr. | tr. | tr. | 0.0020 | tr. |
| 20 | 0.0020 | 3.00 | 0.21 | 0.050 | 0.0025 | 0.0010 | 0.0022 | tr. | tr. | tr. | tr. | 0.0020 |
| 21 | 0.0120 | 3.00 | 0.23 | 0.050 | 0.0009 | 0.0010 | 0.0013 | tr. | tr. | 0.0010 | tr. | tr. |
| 22 | 0.0021 | 0.70 | 0.19 | 0.050 | 0.0009 | 0.0010 | 0.0018 | tr. | tr. | 0.0010 | tr. | tr. |
| 23 | 0.0020 | 1.20 | 0.21 | 0.050 | 0.0009 | 0.0010 | 0.0020 | tr. | tr. | 0.0010 | tr. | tr. |
| 24 | 0.0017 | 2.00 | 0.21 | 0.050 | 0.0009 | 0.0010 | 0.0023 | tr. | tr. | 0.0010 | tr. | tr. |
| 25 | 0.0012 | 4.50 | 0.21 | 0.050 | 0.0009 | 0.0010 | 0.0012 | tr. | tr. | 0.0010 | tr. | tr. |
| 26 | 0.0013 | 3.00 | 1.00 | 0.050 | 0.0009 | 0.0010 | 0.0016 | tr. | tr. | 0.0010 | tr. | tr. |
| 27 | 0.0018 | 3.01 | 3.50 | 0.050 | 0.0009 | 0.0010 | 0.0012 | tr. | tr. | 0.0010 | tr. | tr. |
| 28 | 0.0022 | 3.00 | 0.21 | 0.050 | 0.0020 | 0.0010 | 0.0062 | tr. | tr. | 0.0010 | tr. | tr. |
| 29 | 0.0020 | 3.00 | 0.21 | 0.050 | 0.0150 | 0.0010 | 0.0020 | tr. | tr. | 0.0010 | tr. | tr. |
| 30 | 0.0020 | 3.00 | 0.21 | 0.011 | 0.0009 | 0.0010 | 0.0020 | tr. | tr. | 0.0010 | tr. | tr. |
| 31 | 0.0018 | 3.04 | 0.20 | 0.035 | 0.0009 | 0.0010 | 0.0020 | tr. | tr. | 0.0010 | tr. | tr. |
| 32 | 0.0020 | 3.00 | 0.21 | 0.011 | 0.0009 | 0.0010 | 0.0020 | tr. | tr. | 0.0010 | tr. | tr. |
| 33 | 0.0018 | 3.04 | 0.20 | 0.035 | 0.0009 | 0.0010 | 0.0020 | tr. | tr. | 0.0010 | tr. | tr. |

| No. | Thickness (mm) | Final Annealing Temperature (° C.) × 30 s | Magnetic property: Iron loss $W_{10/400}$ (W/kg) | Magnetic flux density $B_{50}$ (T) | Anisotropy $B_{50L}/B_{50C}$ | Remarks |
|---|---|---|---|---|---|---|
| 1 | 0.25 | 1000 | 12.30 | 1.66 | 1.06 | Comparative Example |
| 2 | 0.25 | 1000 | 12.30 | 1.68 | 1.04 | Invention Example |
| 3 | 0.25 | 1000 | 12.30 | 1.69 | 1.04 | Invention Example |
| 4 | 0.25 | 1000 | 12.50 | 1.68 | 1.03 | Invention Example |
| 5 | 0.25 | 1000 | 12.60 | 1.68 | 1.03 | Invention Example |
| 6 | 0.25 | 1000 | 12.40 | 1.69 | 1.02 | Invention Example |
| 7 | 0.25 | 1000 | 13.80 | 1.65 | 1.05 | Comparative Example |
| 8 | 0.25 | 1000 | 12.30 | 1.65 | 1.06 | Comparative Example |
| 9 | 0.25 | 1000 | 12.30 | 1.69 | 1.04 | Invention Example |
| 10 | 0.25 | 1000 | 12.30 | 1.68 | 1.04 | Invention Example |
| 11 | 0.25 | 1000 | 12.51 | 1.66 | 1.06 | Comparative Example |
| 12 | 0.25 | 1000 | 12.35 | 1.65 | 1.07 | Comparative Example |
| 13 | 0.25 | 1000 | 12.20 | 1.69 | 1.04 | Invention Example |
| 14 | 0.25 | 1000 | 12.00 | 1.69 | 1.04 | Invention Example |
| 15 | 0.25 | 1000 | 12.20 | 1.69 | 1.04 | Invention Example |
| 16 | 0.25 | 1000 | 12.00 | 1.69 | 1.03 | Invention Example |
| 17 | 0.25 | 1000 | 11.90 | 1.69 | 1.04 | Invention Example |
| 18 | 0.25 | 1000 | 12.40 | 1.69 | 1.04 | Invention Example |
| 19 | 0.25 | 1000 | 12.20 | 1.69 | 1.03 | Invention Example |
| 20 | 0.25 | 1000 | 12.20 | 1.69 | 1.04 | Invention Example |
| 21 | 0.25 | 1000 | 12.70 | 1.67 | 1.04 | Comparative Example |
| 22 | 0.25 | 970 | 15.50 | 1.75 | 1.04 | Comparative Example |
| 23 | 0.25 | 980 | 12.80 | 1.72 | 1.03 | Invention Example |
| 24 | 0.25 | 1000 | 12.60 | 1.71 | 1.04 | Invention Example |
| 25 | 0.25 | 1000 | 11.60 | 1.65 | 1.04 | Comparative Example |
| 26 | 0.25 | 1000 | 12.10 | 1.68 | 1.04 | Invention Example |
| 27 | 0.25 | 1000 | 11.80 | 1.65 | 1.04 | Comparative Example |
| 28 | 0.25 | 1000 | 13.50 | 1.66 | 1.07 | Comparative Example |
| 29 | 0.25 | 1000 | 14.20 | 1.65 | 1.06 | Comparative Example |
| 30 | 0.15 | 1000 | 10.80 | 1.65 | 1.06 | Comparative Example |
| 31 | 0.15 | 1000 | 10.80 | 1.685 | 1.03 | Invention Example |
| 32 | 0.10 | 1000 | 10.10 | 1.63 | 1.06 | Comparative Example |
| 33 | 0.10 | 1000 | 10.10 | 1.66 | 1.03 | Invention Example |

As seen from the results of Table 1, all of the non-oriented electrical steel sheets obtained by controlling contents of steel ingredients, especially Al, P and As within a range of the invention have an excellent magnetic flux density $B_{50}$ of not less than 1.68 T as well as a small anisotropy ($B_{50L}/B_{50C}$) of not more than 1.05.

The non-oriented electrical steel sheets according to the invention are high in the magnetic flux density and can be preferably used in not only a driving motor used for a hybrid car and an electric car but also a high-frequency induction motor and a compression motor of air conditioner.

The invention claimed is:

1. A non-oriented electrical steel sheet having a chemical composition comprising C: not more than 0.01 mass %, Si: 1-4 mass %, Mn: 0.05-3 mass %, P: 0.03-0.2 mass %, S: not more than 0.01 mass %, Al: not more than 0.004 mass %, N: not more than 0.005 mass %, As: an amount of As that is not more than 0.003 mass %, and the balance being Fe and inevitable impurities, and wherein a ratio ($B_{50L}/B_{50C}$) between a magnetic flux density $B_{50L}$ in a rolling direction (L direction) and a magnetic flux density $B_{50C}$ in a direction perpendicular to the rolling direction (C direction) is not more than 1.05.

2. The non-oriented electrical steel sheet according to claim 1, further containing one or two of Sb: 0.001-0.1 mass % and Sn: 0.001-0.1 mass %.

3. The non-oriented electrical steel sheet according to claim 1, further containing one or two of Ca: 0.001-0.005 mass % and Mg: 0.001-0.005 mass %.

4. The non-oriented electrical steel sheet according to claim 1, wherein a sheet thickness is 0.05-0.30 mm.

5. The non-oriented electrical steel sheet according to claim 2, further containing one or two of Ca: 0.001-0.005 mass % and Mg: 0.001-0.005 mass %.

6. The non-oriented electrical steel sheet according to claim 2, wherein a sheet thickness is 0.05-0.30 mm.

7. The non-oriented electrical steel sheet according to claim 3, wherein a sheet thickness is 0.05-0.30 mm.

8. The non-oriented electrical steel sheet according to claim 6, wherein a sheet thickness is 0.05-0.30 mm.

* * * * *